US006095908A

United States Patent [19]

Torii

[11] Patent Number: 6,095,908

[45] Date of Patent: Aug. 1, 2000

[54] POLISHING APPARATUS HAVING A MATERIAL FOR ADJUSTING A SURFACE OF A POLISHING PAD AND METHOD FOR ADJUSTING THE SURFACE OF THE POLISHING PAD

[75] Inventor: Kouzi Torii, Tokyo, Japan

[73] Assignee: NEC Corporation, Tokyo, Japan

[21] Appl. No.: 09/338,609

[22] Filed: Jun. 23, 1999

[30] Foreign Application Priority Data

Jun. 29, 1998 [JP] Japan ..... 10-182926

[51] Int. Cl.[7] ..... B24B 29/00

[52] U.S. Cl. ..... 451/285; 451/41; 451/56; 451/72; 451/443

[58] Field of Search ..... 451/36, 41, 56, 451/72, 443, 444, 287, 288, 285

[56] References Cited

U.S. PATENT DOCUMENTS

| | | | |
|---|---|---|---|
| 5,433,650 | 7/1995 | Winebarger | 451/6 |
| 5,456,627 | 10/1995 | Jackson et al. | 451/11 |
| 5,486,131 | 1/1996 | Cesna et al. | 451/56 |
| 5,492,594 | 2/1996 | Burke et al. | 216/86 |
| 5,536,202 | 7/1996 | Appel et al. | 451/285 |
| 5,562,524 | 10/1996 | Gill, Jr. | 451/1 |
| 5,823,854 | 10/1998 | Chen | 451/9 |
| 5,941,762 | 8/1999 | Ravkin et al. | 451/56 |

FOREIGN PATENT DOCUMENTS

| | | |
|---|---|---|
| 64-51267 | 2/1989 | Japan . |
| 4-242929 | 8/1992 | Japan . |
| 8-148453 | 6/1996 | Japan . |
| 9-254018 | 9/1997 | Japan . |

*Primary Examiner*—Timothy V. Eley
*Assistant Examiner*—Dung Van Nguyen
*Attorney, Agent, or Firm*—Young & Thompson

[57] ABSTRACT

In a polishing apparatus, a polishing pad 102 is fixed on top of a circular platen 101. The platen 101 is rotated. A carrier 103 holds either a wafer product or an adjusting wafer. The material of the adjusting wafer is equivalent to the principle component which makes up the surface layer of the wafer product. The carrier 103 is rotated. The carrier 103 is lowered above the rotating platen 101, and a given load is added, thereby polishing the polishing pad 102. A dressing mechanism 106, comprised of a dresser 107, is placed beside the platen 101. The polishing arm 108 is revolvable, so the carrier 103 can be horizontally moved. A loading cup 110 and an unloading cup 111 are both fixed within the path range where the carrier 103 moves. A loader 109 and an unloading unit 112 are both placed near the respective loading cup 110 and unloading cup 111. A cleaning platen 113 is also fixed within the path range where the carrier 103 moves. An adjusting wafer/storage unit 114 is fixed within the path range where the carrier 103 is moved by the rotation of the polishing arm 108. The adjusting wafer 124 is used to adjust the surface of the polishing pad 102.

18 Claims, 11 Drawing Sheets

(a)

(b)

(a)

(b)

(a)

(b)

POLISHING APPARATUS HAVING A MATERIAL FOR ADJUSTING A SURFACE OF A POLISHING PAD AND METHOD FOR ADJUSTING THE SURFACE OF THE POLISHING PAD

BACKGROUND OF THE INVENTION

1. Field of the Invention

The present invention relates to a polishing apparatus and method for adjusting a surface of a polishing pad. It specifically relates to a polishing apparatus, where the surface of the polishing pad is polished so as to adjust the surface. The present invention can be used, for example, in the chemical mechanical polishing (CMP) process, through which the surface of an object, such as a silicon wafer is polished.

2. Description of the Related Art

Within the ordinary process steps of manufacturing a semiconductor device, an active device such as a MOS transistor is formed on a silicon substrate; and an aluminum interconnect is patterned and formed over the surface of the substrate. Therefore, the surface of an inter-layer insulating layer becomes rough conforming to the rugged shape of device elements and/or wirings. The roughness of the surface causes a deterioration of the dimensional precision when forming an upper-layer interconnect, by using, for example, a photo-lithography process.

In recent years, the intervals between adjacent interconnects, which are formed in semiconductor devices, have become shorter, and multiple-layered interconnects have become commonplace. Accordingly, an evenness of the surface of the semiconductor substrate, on/or above which an interconnecting layer, a device, an under-layer interconnect, and an inter-layer insulating layer are formed, is indispensable. For example, the conventional method of smoothing the above surface by using a process of filling any concave region of the surface of an inter-layer insulating layer with a fluid coating layer, such as the SOG (Spin-on-Glass) coating process, does not comply with the demands for the evenness of the above surface. Accordingly, the CMP (Chemical Mechanical Polishing) process has recently been used; where the inter-layer insulating layer, which is a base for the formation of an interconnect, is chemically and mechanically polished, so as to form an even surface.

The CMP process has a higher capability of removing the bumps of the surface, so as to smooth it, than those of the conventional smoothing processes. However, the CMP process has a somewhat low controllability. This emanates from the "age" deterioration of the surface of a polishing pad due to aging, which is utilized in the CMP process; and/or the influence of a dressing process. Specifically, the age deterioration, such as changes in the polishing grain concentration and/or elastic modulus, on the surface of a polishing pad may occur. This is dependent upon, for example, how the polishing pad has been preserved. In addition, where a dressing process does not fit with a given polishing requirement, the evenness of the surface of the polishing pad may get worse, causing a change in the polishing rate. For correction of the change in the polishing rate, the surface of the polishing pad will need adjusting. According to the conventional method of adjusting the surface of a polishing pad, at first, the surface of the polishing pad is subjected to a dressing process by a dresser, on the surface of which diamond particles are buried by plated nickel. Dressing is sometimes called "seasoning". At the same time or thereafter, a dummy wafer with the surface layer, formed on the surface of the silicon substrate, is utilized to polish the surface of the polishing pad. Wherein, the surface layer of the dummy wafer formed, is made of a material, which is identical to one making up the surface layer of a product wafer to be polished. The adjusting wafer (dummy wafer), used for adjusting the surface of the polishing pad, is fabricated by forming an oxide layer or a metal layer on the surface of a silicon substrate. However, since the adjusting wafer can be used only once or twice, generally, (which though, is dependent upon the thickness of the layer) it is necessary to reform the layer or use another adjusting wafer. The limitation in the case of using a single adjusting wafer, comes from the fact that when the Si surface of the substrate of the adjusting wafer is exposed, it causes a change in the polishing rate. The change in the polishing rate emanates from the difference in the polishing properties between the surface layer of a wafer product, and the silicon substrate of the adjusting wafer.

A polishing pad, made of, in particular, polyurethane foam, generally needs seasoning, right after being replaced. This emanates from the fact, that the probability is high that the polishing rate changes; and that a scratch occurs on a surface layer of a wafer, which has been polished, within twenty to thirty polishing-runs, after the polishing pad has been replaced. Accordingly, it is necessary to polish using twenty to thirty dummy wafers for seasoning, right after the polishing pad has been replaced.

Thus, for the seasoning process, extra adjusting wafers (dummy wafers), are required. In addition, the polishing pad has to be subjected to the seasoning process several times by using multiple, adjusting wafers. This is because the amount shaved by polishing has to be controlled below a certain value, so as to prevent the silicon substrate of each adjusting wafer from being exposed. This causes an occurrence of a problem, that extra time has to be spent for transmitting adjusting wafers and a possible increase in the loss of time.

FIG. 1 is a plan view showing an outline of the conventional polishing apparatus.

A polishing pad 2 is attached to the top of a circular platen 1. The platen 1 is rotated on its own vertical and central axis, with the help of a rotating force, transmitted via a rotating drive shaft, (not shown in the Figure) which is fixed under the platen 1. A carrier 3, which holds a semiconductor wafer or an object to be polished, is placed above the platen 1. The carrier 3 is rotated on its own vertical and central axis, with the help of a spindle mechanism supported by a polishing arm 8; and is placed in such a manner that the under-surface of the semiconductor wafer, held by the carrier 3, can face the polishing pad 2. That is to say, a semiconductor wafer is attached to the carrier 3, in such a manner that the to be polished surface of the semiconductor wafer can face the polishing pad. The carrier 3 is next lowered, onto the surface of the rotating platen 1, and a load is added. Thereafter, the carrier 3 is rotated, in the same direction as that of the platen 1, while an abrasive is supplied to the surface of the polishing pad, thereby polishing the semiconductor wafer. Furthermore, a dressing mechanism, comprised of a dresser 7, is placed beside the platen 1. With this dressing mechanism 6, the polishing pad is dressed, as the semiconductor wafer is being polished or during a break in the polishing processes.

The polishing arm 8 is revolvable, so the carrier 3 can be horizontally moved. A loading cup 10 and an unloading cup 11 are both fixed within the path range, where the carrier 3 moves and reaches. A cleaning platen 13 is also fixed within the path range. A loader 9 and an unloading unit 12 are both placed near the respective loading cup 10 and unloading cup 11.

FIG. 2 is a flowchart showing an example of the conventional polishing steps, including both the steps of adjusting the surface of the polishing pad and the steps of polishing a wafer product.

After the polishing pad has been replaced with a new one, the surface of the polishing pad is subjected to a dressing process for approximately twenty minutes, which is performed by the dresser 7, with the platen 1 is rotated. Consequently, the surface of the polishing pad 2 is scraped by more than several microns in depth. A cassette which stores a plurality of adjusting semiconductor wafers is set on the loader 9 and one of the adjusting semiconductor wafers is placed on the load cup 10. And then, the adjusting semiconductor wafer is mounted on the carrier 3. It is then polished for, for example, three minutes to adjust the pad surface Wherein, the adjusting semiconductor wafer has a silicon oxide layer of 1 micron, in thickness, on its surface. Thereafter, the adjusting semiconductor wafer, is moved into the unloading unit 12 via the unloading cup 11. In the same manner as described above, the polishing of the adjusting semiconductor wafer is repeated twenty times, as an example. Next, a measuring wafer, which is used to measure the polishing rate, is polished only once; and the polishing rate is measured. Thereafter, several tens of wafer products are polished under a certain condition. The adjusting wafer, is polished next, two runs or so, thereby adjusting the surface of the polishing pad. Next, the measuring wafer is polished again, thereby measuring the polishing rate. Several tens of wafer products are polished next, under a certain condition. Thereafter, the same process steps, ranging from the step of polishing the surface of the polishing pad so as to adjust it, to the step of measuring the polishing rate and polishing the wafer products, is repeated.

It is noted that after several tens of wafer products have been polished, polishing process for adjusting the polishing pad is also performed, when no polishing process has been performed on wafer products for more than a fixed period of time; or when it becomes necessary to radically change the polishing condition.

The number of necessary adjusting wafers, which are used in the above process steps, fall within the range of 5% to 20% of the total number of wafer products, processed. The number also depends upon the life span of the polishing pad 2.

As described above, the conventional polishing apparatus and the conventional method of adjusting the surface of the polishing pad 2 both have several problems. The first problem is that the conventional polishing apparatus has a low rate of operation in the polishing process for wafer products. The second problem is that the cost of the conventional polishing apparatus is high, due to the fact that it is necessary to prepare wafers, designated to be used to adjust the surface of the polishing pad. This also causes an increase in the load on the other manufacturing process steps. The last problem is that it is difficult to develop a fully-automated polishing apparatus due to constraints, relevant to the above causes. In particular, it is difficult to develop a fully-automated polishing apparatus, which needs to use a lot of adjusting wafers, due to the fact that an exclusive storage unit for the adjusting wafers is a must; and the number of necessary cassettes, for a wafer supplying unit (not shown in Figures), is high. Further, it is needed to control the cassettes. Therefore, it is difficult to construct an automated polishing apparatus.

In the Japanese Patent Application Laid-open No. Hei-8-148453, the configuration of a wafer holding unit has been disclosed. Wherein, the wafer holding unit is comprised of: a retainer, on the surface of which diamond particles are buried; and a wafer which is to be polished. The wafer is polished by a polishing pad, and at the same time the polishing pad is seasoned by the diamond particles. Due to the configuration of the retainer with diamond particles, the life span of the polishing pad can be expanded. Further, in the above document, a technique for preventing a periphery of a wafer changing the shape is mentioned as a prior art. However, it is not disclosed to an adjusting a surface of a polishing pad.

Furthermore, in the Japanese Patent Application Laid-open No. Sho-64-51267, the configuration of a seasoning apparatus for a polishing pad has been mentioned. The seasoning apparatus has a configuration, where a seasoning material is mounted on a carrier plate, via a packing material. This configuration allows for an easy replacement of the seasoning material. In addition, since the packing material functions as a buffer material, the pressure put onto the polishing pad can be adjusted. In this specification, however, the means for expanding the life span of an adjusting material, which is used to polish the polishing pad, has not been disclosed.

SUMMARY OF THE INVENTION

The object of the present invention is to provide a polishing apparatus where the rate of operation in the operation of polishing wafer products is greatly improved.

To attain the above objective, according to an aspect of the present invention, a polishing apparatus is provided, comprising: a polishing pad for polishing an object; an adjusting tool for adjusting a surface of the polishing pad, the adjusting tool composed entirely of a main ingredient of a surface layer of the object; a first unit for holding the object and pressing the object against the polishing pad; and a second unit for holding the adjusting tool and pressing the adjusting tool against the polishing pad when the object is not pressed against the polishing pad.

The first unit serves as the second unit.

The adjusting tool is a holding ring for holding the object.

The polishing apparatus further comprises a third unit for holding a dresser and pressing the dresser against the polishing pad and the third unit serve as the second unit.

The adjusting tool is a ring shape and provided around the dresser.

The polishing apparatus further comprises a storage unit for storing the adjusting tool.

An underside of the holding ring is not in contact with the polishing pad when the holding ring holds the object.

The first unit further comprises a shim for adjusting a distance between the holding ring and the polishing pad.

The first unit further comprises a means for individually applying pressure to the holding ring and the object.

The third unit comprises a means for individually applying pressure to the adjusting tool and the dresser.

The first unit can hold a plurality of the objects or a plurality of the adjusting tools and press the plurality of the objects or the plurality of the adjusting tools against the polishing pad at the same time.

According to another aspect of the present invention, an adjusting method of a surface of a polishing pad in a method of polishing an object by pressing against the polishing pad, comprising pressing an adjusting tool composed entirely of a main ingredient of a surface layer of the object against the polishing pad when the object is not pressed against said polishing pad.

The surface layer of the object can be metal and the adjusting tool can be the same bulk metal as the metal.

The surface layer of the object can be silicon oxide and the adjusting tool can be bulk quartz. metal and the adjusting tool is the same bulk metal as the metal.

The surface layer of the object can be alloy metal and the adjusting tool can be metal which is included in the alloy, and the content by percentage of the metal being more than 50%.

According to the present invention, the number of adjusting tools is drastically reduced; and the rate of operation in polishing wafer products, is greatly improved by keeping high quality wafer products

BRIEF DESCRIPTION OF DRAWINGS

The above and other objects, features and advantages of the present invention, will become apparent from the following detailed description, in the embodiment section; when taken in conjunction with the accompanying drawings, wherein.

DETAILED DESCRIPTION OF THE PREFERRED EMBODIMENTS

Hereafter, embodiments of the present invention will be described with reference to Figures.

(First embodiment)

Figure 1:
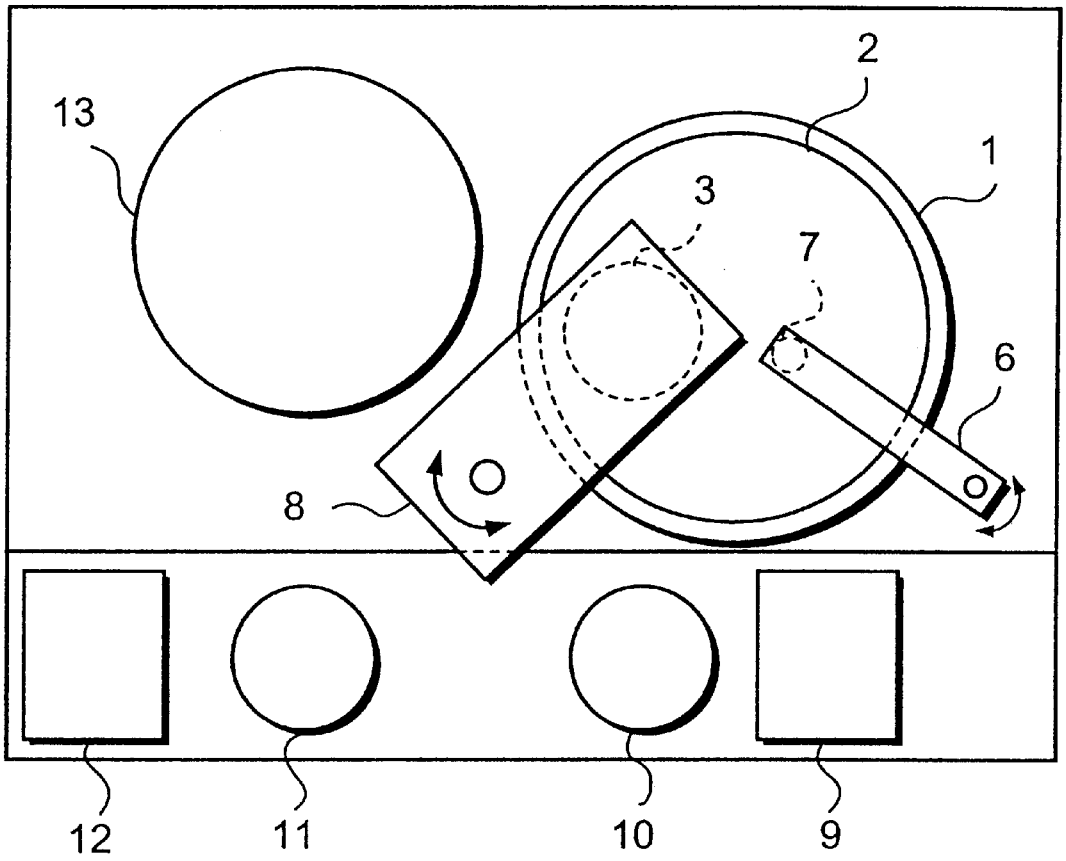
Fig. 1 PRIOR ART
FIG. 1 illustrates the outline of the conventional polishing apparatus.
Figure 2:
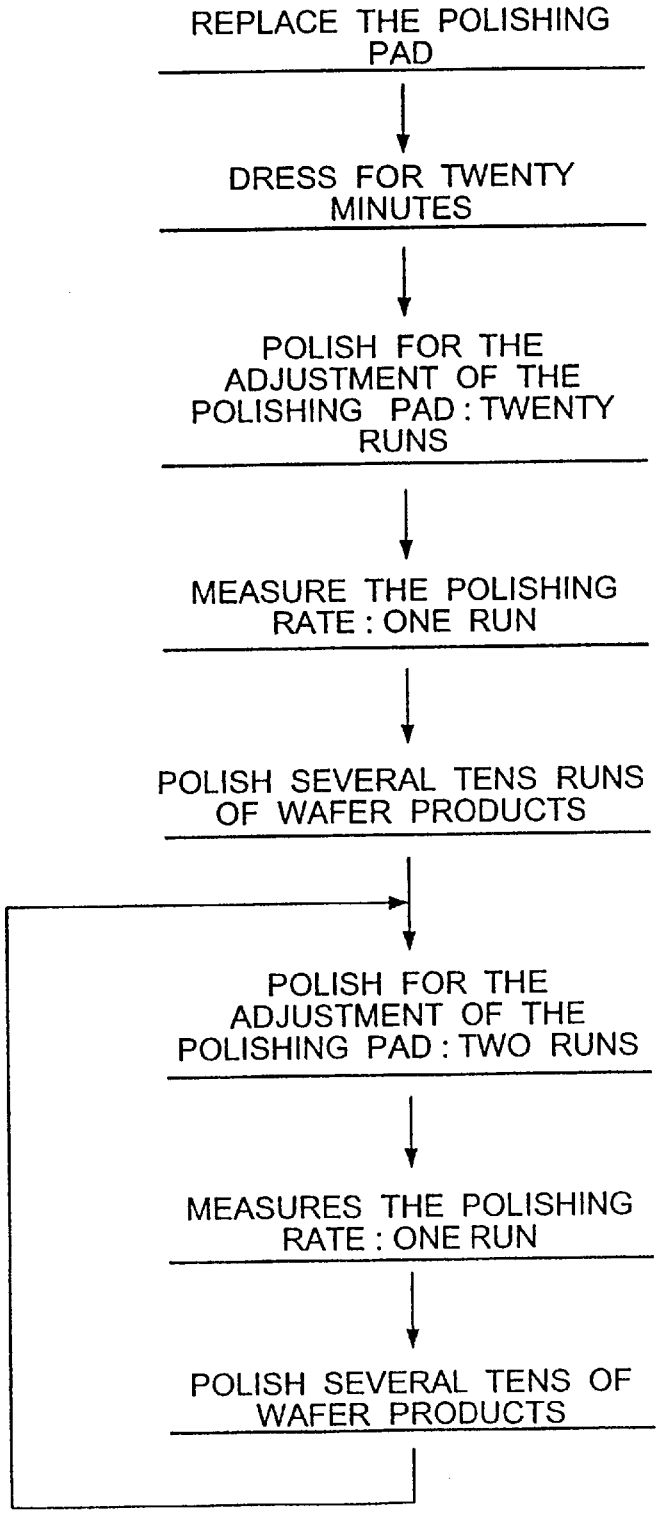
Fig. 2 PRIOR ART
FIG. 2 illustrates a flowchart, showing the conventional process steps of polishing; including an adjusting process, for the surface of a polishing pad and a polishing process, for a wafer product.
Figure 3:
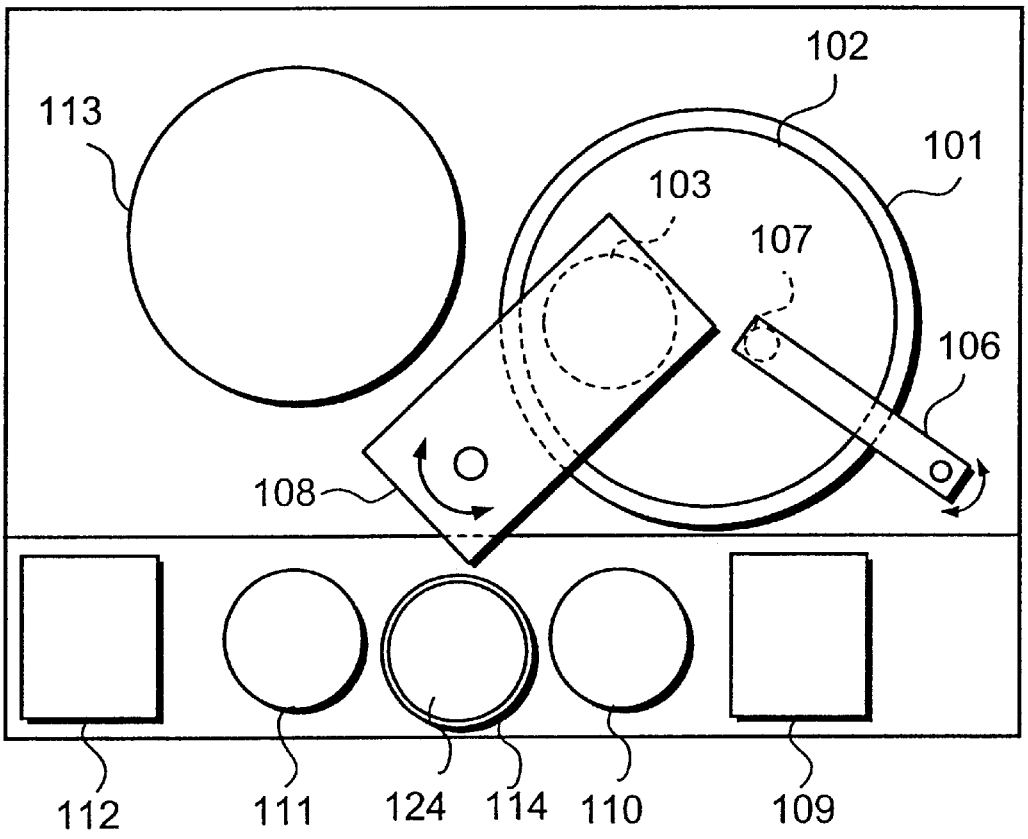
FIG. 3 illustrates the configuration of a polishing apparatus, according to the first embodiment of the present invention.
Figure 4:
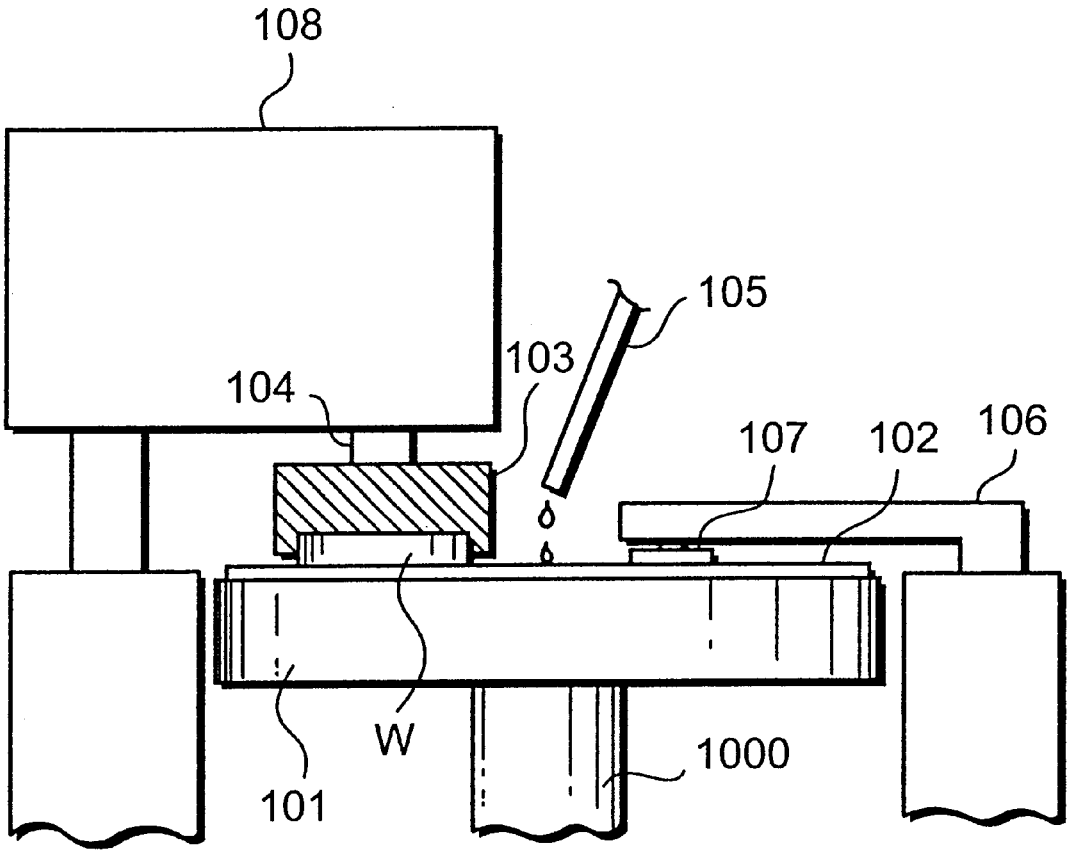
FIG. 4 illustrates a cross section of the polishing apparatus, according to the first embodiment of the present invention.

FIG. 3 shows an plan view of a polishing apparatus, according to the first embodiment of the present invention. FIG. 4 is a cross section of part of the polishing apparatus.

In FIG. 3 and FIG. 4, a polishing pad 102 is fixed on top of a circular platen 101. The platen 101 is rotated on its own vertical and central axis, with the help of a revolving power transmitted via a revolvable drive shaft 1000, which is fixed on the underside of the platen 1. A carrier 103, which holds an object, which is to be polished or a semiconductor wafer W, is prepared above the platen 101. Wherein, the semiconductor wafer W means either a wafer product or an adjusting wafer, which is used to adjust the polishing pad 102. The carrier 103 is rotated on its own vertical and central axis, by the help of a spindle mechanism 104; and is held in such a manner that the under-surface of the semiconductor wafer W can face the polishing pad 102. The spindle mechanism 104 is supported by a polishing arm 108. The semiconductor wafer W is, for example, vacuumed and held in the carrier 103. With the above configuration, the semiconductor wafer W is polished in the following steps: The semiconductor wafer is first attached to the carrier 103 in such a manner that the polishing surface of the semiconductor wafer W can face the polishing pad 102, as described above. The carrier 103 is lowered next, above the rotating platen 101, and a given load is added. Thereafter, the carrier 103 is rotated in the same direction, as that of the platen 101; while an abrasive is supplied to the surface of the polishing pad 102, thereby polishing the semiconductor wafer W. Furthermore, a dressing mechanism 106, comprised of a dresser 107, is placed beside the platen 101. The arm of the dressing mechanism 106 rotates, so the dresser 107 can move horizontally. With this dressing mechanism 106, the surface of the polishing pad 102 is dressed by pushing the dresser 107; while the semiconductor wafer W is being polished or during a break in the polishing processes.

The polishing arm 108 is revolvable, so the carrier 103 can be moved horizontally. A loading cup 110 and an unloading cup 111 are both fixed, within the path range, where the carrier 103 moves. A loader 109 and an unloading unit 112 are both placed near the respective loading cup 110 and unloading cup 111. A cleaning platen 113 is also fixed, within the path range, where the carrier 103 moves.

An adjusting wafer/storage unit 114 is fixed within the path range, where the carrier 103 is moved by the rotation of the polishing arm 108. An adjusting wafer 124, such as a wafer made of quartz, is used to adjust the surface of the polishing pad 102. The shape and size of the adjusting wafer 124 can be equal to those of the semiconductor wafer product. The adjusting wafer is placed in the storage unit 114. The adjusting wafer/storage unit 114, preferably, possesses the capacity for preventing the adjusting wafer 124, from getting dry. This is attained by putting pure water or other related liquid in it, as an example.

It is noted that a material which has the same principle component to the material making up the surface layer of an object, (a wafer product) which is to be polished, makes up the adjusting wafer 124. For example, in the case where the object, which is to be polished, is a silicon wafer; and the material, making up the surface layer of the object, is an silicon oxide, such as a nondoped silicate glass (NSG), which is formed by using a plasma processing, then, a similar material to the silicon oxide makes up an adjusting wafer 124. Wherein, material similar the above can be quartz. On the other hand, in the case where the material, making up the surface layer of the object, is the phosphorous-doped silicate glass (PSG) or the Boron/Phosphorous silicate glass (BPSG); then the adjusting wafer 124 is made of a silicon oxide or a silicon oxide-like material, which is equivalent to the principle component of the surface layer of the wafer product. Accordingly, the adjusting wafer 124, can be quartz, quartz doped with phosphorous, or quartz doped with phosphorous and boron. Furthermore, in the case where the surface layer of the object is a metal layer, which is later used in the formation of a conductive pattern; a similar metal, to that of the metal layer of the surface of the object, is used. For example, where the metal layer of the surface of the wafer product is made of tungsten, copper (Cu), aluminum (Al), titanium (Ti), tantalum (Ta), or titanium nitride (TiN); the adjusting wafer 124 can be tungsten, copper, aluminum, titanium, tantalum, or titanium nitride, respectively. Furthermore, where the surface layer of the object is made of an Al/Si/Cu layer; either: aluminum, which is equivalent to the principle component of the Al/Si/Cu layer; or aluminum, which is doped with both Si and Cu, is used.

A polishing test can determine the material, selected from the following materials, which is to be used for the adjusting wafer 124. A material that is similar to that of the material making up the surface layer of the object (wafer product), and a material that is equivalent to the principle component of the surface layer of the object. It is noted that the "principal component" means to be one that is included in more than 50% of its material.

The thickness of the adjusting wafer 124, can be equal to or more than that of the wafer product. In addition, the thickness of the adjusting wafer 124, can be more than that of the wafer product; as long as a transmitting and a polishing process can be normally performed. Thereby, the adjusting wafer 124 has a longer life span.

Next, the process steps of polishing a semiconductor wafer product are explained below: First, the semiconductor wafer product is transmitted to the loading cup 110, via the loader 109. The carrier 103, then vacuums and holds the semiconductor wafer product. Next, the carrier 103 is moved above the polishing pad 102, which is fixed on the spinning platen 101. The semiconductor wafer product is pushed onto the polishing pad 102, and polished. Thereafter, the carrier 103 is moved above the cleaning platen 113; and the polished wafer product is then cleaned by pure water. The cleaned semiconductor wafer product is then moved into the unloading cup 111. Lastly, the semiconductor wafer product is moved into the unloading unit 112.

When it is necessary to polish the surface of the polishing pad 102, so as to adjust the surface (including a running-in adjustment); the carrier 103 vacuums the adjusting wafer 124 (e.g., made of quartz), from the adjusting wafer/storage unit 114, and holds it. The adjusting wafer 124 is then moved by the carrier 103, to above the platen 101; and polished for adjusting the polishing pad 102. The adjusting wafer 124, can be continuously polished for several tens of minutes, as necessary. Accordingly, unlike the conventional polishing process, it is unnecessary to divide entire necessary runs of polishing for the adjustment into several groups of runs, thereby polishing the polishing pad 102, in the group unit. Wherein, for example, each group has two runs or twenty runs. It is preferable that the polishing process and the dressing process are both simultaneously performed. The condition for polishing for the adjustment and for dressing can be equivalent to that for the polishing of a wafer product. Upon the termination of the polishing process for the adjustment, the adjusting wafer 124, is returned into the storage unit 114. When the surface of the polishing pad 102 is adjusted again, the adjusting wafer 124, is taken and moved onto the polishing pad 102, by the carrier 103; and it is polished. The adjusting wafer 124, according to the present invention, can be used repeatedly.

An example of the condition for polishing the semiconductor wafer product and the adjusting wafer 124, is described below. The pressure, which is put on each wafer, is equal to 500 g/cm$^3$; the rotation frequency of the platen 101 is equal to 20 rpm; and the revolution frequency of the carrier 103 is equal to 25 rpm. The time for polishing is optional. The polishing pad 102 is made of polyurethane foam. The abrasive includes fumed silica, and its pH is controlled, so as to be equal to approximately eleven. The dresser 107 is of a disk shape, with its outside diameter of 10 cm; and is comprised of #100 type diamond particles, plated with nickel on its own plate. A load of 50 g/cm$^2$ is put on the dresser 107. The revolution frequency of the dresser 107 is equal to 25 rpm. The revolution frequency of the platen 101, under a dressing process, is the same as that under the polishing process. The time period and timing for dressing are optional. It is noted that the above conditions for polishing and dressing are described, just as an example. The present invention is not limited to the above conditions only.

In the first embodiment, since a quartz wafer 124, is used to adjust the surface of the polishing pad 102; the process of fabricating the adjusting wafer 124, can be simplified, and its cost can also be decreased. The adjusting quartz wafer 124 can be repeatedly used 100 times or more longer than that of the conventional adjusting material, which is made from a silicon wafer and a silicon oxide layer, 1 micron thick, on the silicon wafer. This emanates from the structure of the adjusting wafer 124, made of a similar material to the one included in the surface layer of the wafer product. Due to the structure of the adjusting wafer 124, the adjusting wafer 124 can be continuously used; as long as the surface of the adjusting wafer 124 protrudes over the carrier 103. Needless to say, the allowable number of times for repeating the polishing process is dependent upon the thickness of the adjusting wafer 124. The thicker the adjusting wafer is, the longer the allowable number becomes.

Furthermore, since the polishing process can be continuously made, so as to adjust the surface of the polishing pad 102; the total time of polishing is shorter. In the conventional polishing process, the surface of the polishing pad is polished at several separate times for adjustment, by using ten to forty adjusting wafers. This requires time-stoppages for transmitting the multiple adjusting wafers, only for each polishing process. Conversely, according to the first embodiment, since a single adjusting wafer has an ability of repeating the process of polishing the polishing pad many times; so it is not necessary to have separate times for transmitting the multiple adjusting wafers, only for each polishing process.

Furthermore, an automated polishing apparatus can be easily developed, according to the present invention. According to the configuration of the conventional polishing apparatus, a wafer product and an adjusting wafer are both provided, from a cassette; so two pieces of exclusive storage unit are necessary, in order to automate the polishing process. Therefore, there is a problem that the conventional, automated polishing apparatus has to be large in size. To solve this problem, the polishing apparatus, according to the first embodiment of the present invention, embeds an adjusting wafer; which can be continuously used for a long period, so an exclusive storage unit for storing multiple adjusting wafers is not necessary. And the size of the polishing apparatus can be small.

(Second embodiment)

Figure 5:
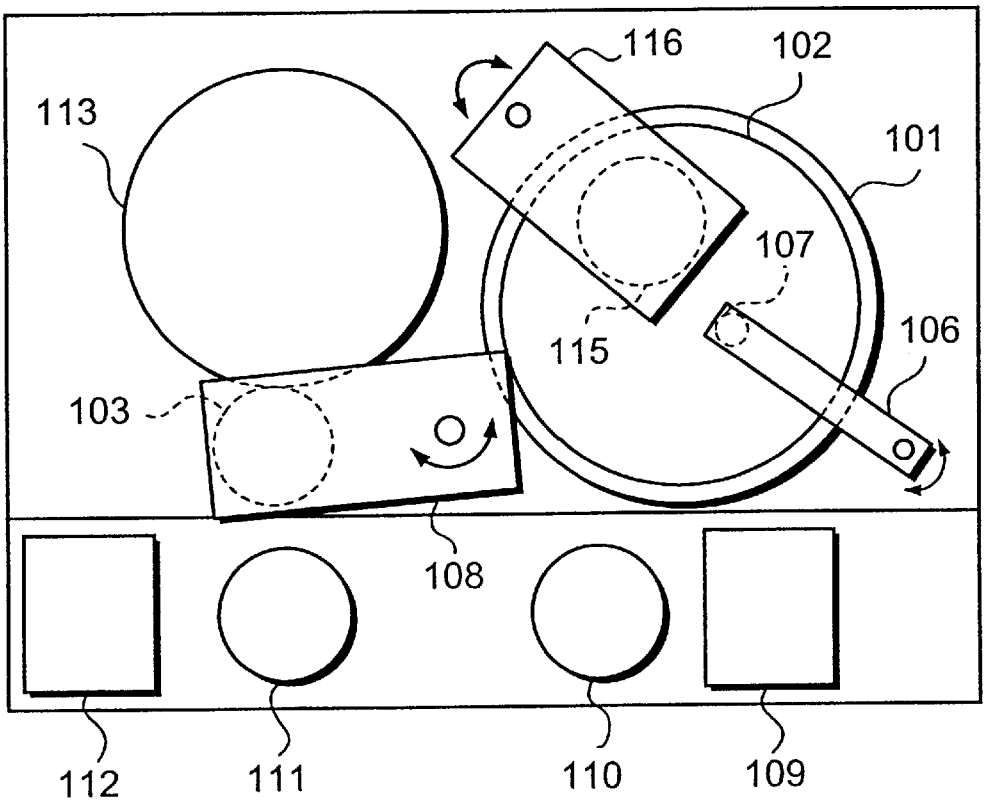
FIG. 5 illustrates the configuration of a polishing apparatus, according to the second embodiment of the present invention.

Next, a polishing apparatus, according to the second embodiment of the present invention, will be described while referring to FIG. 5. FIG. 5 illustrates the configuration of the polishing apparatus. The same reference numerals, as those in FIG. 3 and FIG. 4, are attached to the elements in FIG. 5, which have the same configuration, as those in FIG. 3 and FIG. 4.

Figure 6:
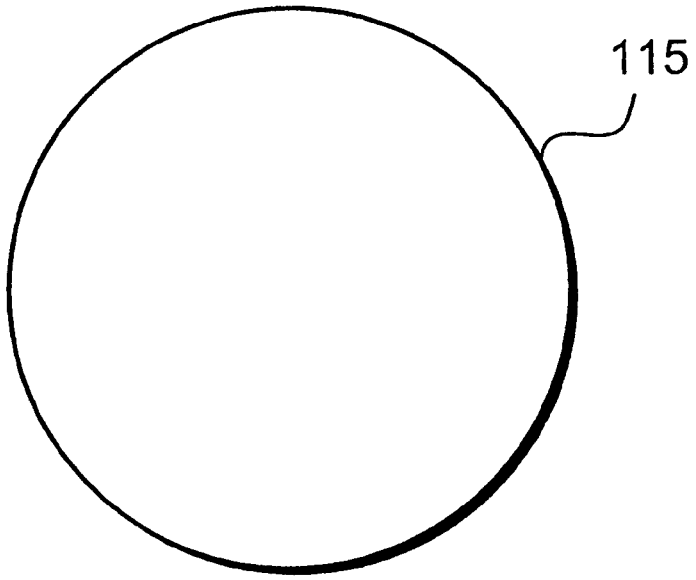
FIG. 6(*a*) and FIG. 6(*b*) are enlargements of an adjusting block and other adjacent elements, in the polishing apparatus, according to the second embodiment of the present invention.
Figure 6:
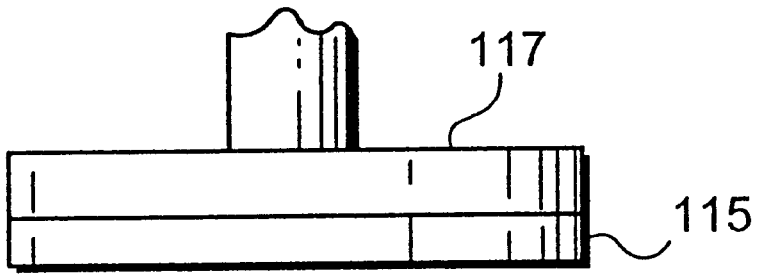

The polishing apparatus of the second embodiment includes an adjusting block 115, which is an adjusting material, that is used to adjust the surface of a polishing pad 102, and which is made of the same material in its principle component as that making up the surface layer of the wafer product. The adjusting block 115 is given a pressure by an exclusive, pressure applying mechanism 116. And the polishing pad 102, which is fixed on top of a platen 101, is also given the same pressure via the adjusting block 115. A wafer product is polished by using a polishing arm 108, in the same manner as in the first embodiment. For the adjustment of the surface of the polishing pad 102, the rotation of the pressure applying mechanism 116 moves the adjusting block 115 from a standing place to above the polishing pad 102. The adjusting block 115 receives a pressure. And, the polishing pad 102 receives the same pressure via the adjusting block 115. As shown in FIG. 6(*a*) and FIG. 6(*b*), the pressure applying mechanism 115 includes a cylinder structure, as an example. FIG. 6(*a*) and FIG. 6(*b*) illustrate an enlargement of the adjusting block 115 and its adjacent elements. FIG. 6(*a*) illustrates the base of the adjusting block 115, whereas FIG. 6(*b*) illustrates a side view of the adjusting block 115. The adjusting block 115 is mechanically fixed on the plate 117, which is fixed on the main body (not shown in the Figure) of the pressure applying mechanism 115. The plate 117 can be rotated on its own vertical and central axis, by a motor (not shown in the Figure). A dressing mechanism 106 dresses the polishing pad 102 in the same manner as that described in the first embodiment, during or after polishing.

The adjusting block 115 is 3 cm in its outside diameter, which is the same as that of the semiconductor wafer product, for example.

In the second embodiment, it is unnecessary for the adjusting material (adjusting wafer), which is used to adjust the surface of the polishing pad 102, to be equal, in shape, to that of a semiconductor wafer product, due to the fact that the adjusting material (adjusting wafer) and the pressure applying mechanism 115 are separately and independently placed away from the mechanism for polishing the wafer product (109, 110, 108, 103, 111, and 112). For example, the adjusting material (adjusting wafer) can be a square in shape, and there is no limitation to its thickness. That is to say, the adjusting wafer, according to the present invention, can be incomparably much thicker than the ordinary wafers. For example, the thickness of the adjusting wafer can be equal to or more than several cm. Therefore, the adjusting wafer has a very long life span, and the frequency of replacing it with new ones becomes largely reduced.

(Third embodiment)

Figure 7:
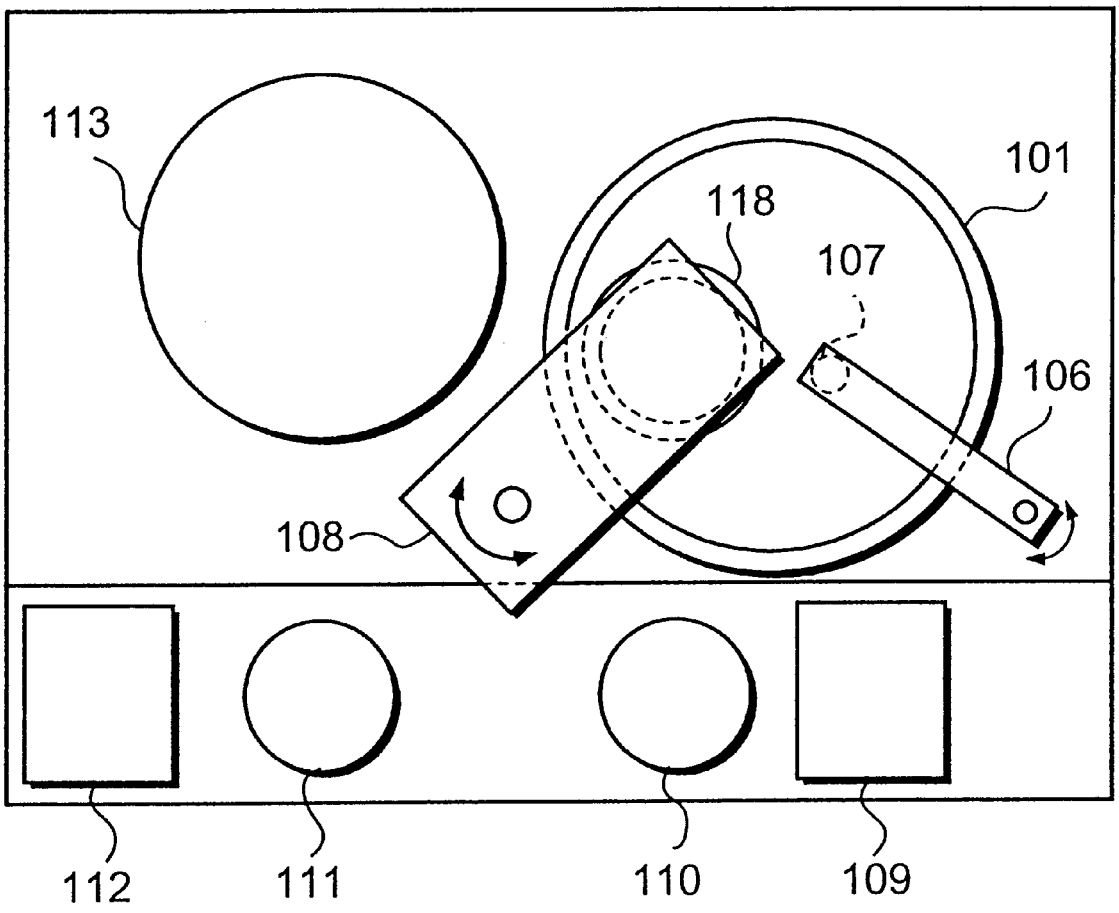
FIG. 7 illustrates the configuration of a polishing apparatus, according to the third embodiment of the present invention.
Figure 8:
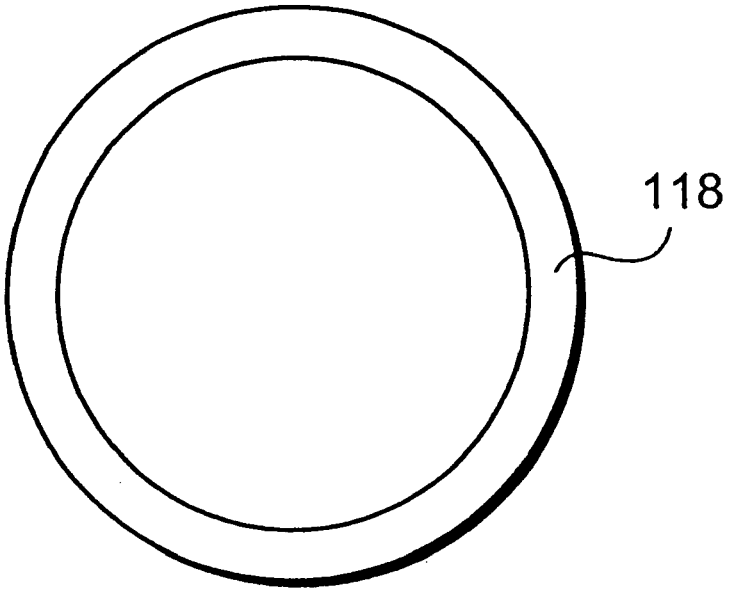
FIG. 8(*a*) and FIG. 8(*b*) are enlargements of a holding ring and other adjacent elements, in the polishing apparatus, according to the third embodiment of the present invention.
Figure 8:
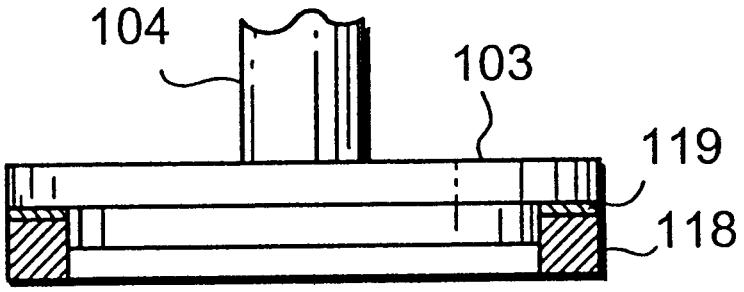

Next, a polishing apparatus, according to the third embodiment of the present invention, will be described with reference to Figures. FIG. 7 illustrates the configuration of the polishing apparatus. The same reference numerals as those in FIG. 3 to FIG. 6 are attached to the same elements in FIG. 7. The polishing apparatus, according to the third embodiment of the present invention, includes a holding ring 118, which makes up a carrier 103 and holds a wafer product during the process of polishing. The holding ring 118 plays a role, as an adjusting material, and of adjusting the surface of a polishing pad 102. The holding ring 118 is made of a material, which is equivalent to the principle component of the surface layer of the wafer product. FIG. 8(*a*) and FIG. 8(*b*) illustrate enlargements of the holding ring 118 and its adjacent elements. FIG. 8(*a*) illustrates a base of the holding ring 118, whereas FIG. 8(*b*) illustrates a cross section of the carrier 3, which includes the holding ring 118. A shim 119, which is made of resin, is filled, so as to adjust the vertical location of the holding ring 118.

For adjustment of the surface of the polishing pad 102, the holding ring 118 is given a pressure while not holding a wafer product. The polishing pad 102 is also given the same pressure via the holding ring 118. The condition, for polishing the polishing pad 102 so as to adjust it, can be equal to that for polishing the wafer product, for example.

The holding ring 118 has a thickness of approximately 3 cm. And its inside diameter is equal to the value obtained by adding the outside diameter of the semiconductor wafer product to a value ranging from 1 to 2 mm; and its outside diameter is equal to the value obtained by adding the outside diameter of the semiconductor wafer product to a value ranging from 20 to 60 mm, as an example.

It is preferable that the underside of the holding ring 118, is equal to or higher, in vertical location, than the underside of the semiconductor wafer product; when the semiconductor wafer product is vacuumed and held. If the protruding height of the semiconductor wafer product (i.e., the protruding height from the underside of the carrier 103 to the upper side of the semiconductor wafer product) is decreased to, or to less than a given value, the shim 119 should be replaced with a thicker one. Furthermore, the life span of the holding ring 118 can be extended, due to a configuration where the holding ring 118 and the semiconductor wafer product are separately and independently given a pressure.

The polishing apparatus, according to the third embodiment of the present invention, has a simpler structure than those of the first and second embodiment. Therefore, a polishing apparatus with multiple heads, having a plurality of carriers to a single platen, is also easily developed by utilizing the configuration of the polishing apparatus of the third embodiment.

(Fourth embodiment)

Figure 9:
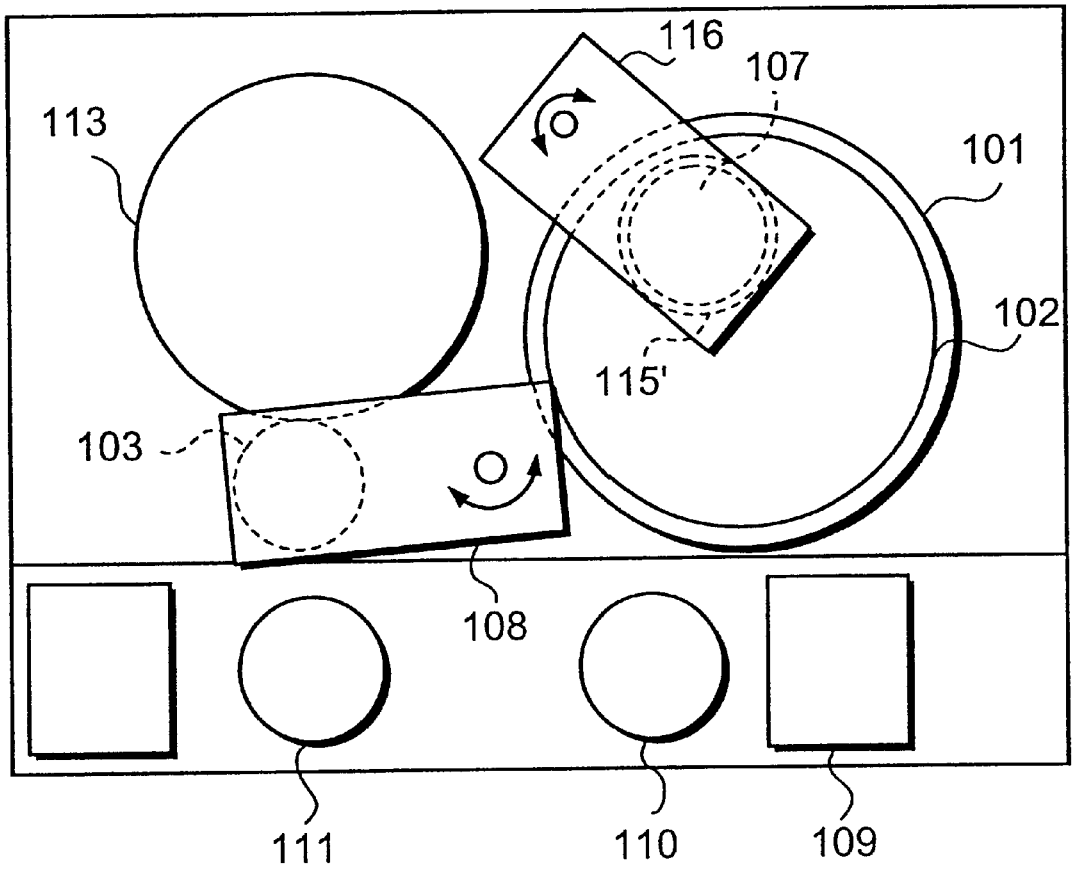
FIG. 9 illustrates the configuration of a polishing apparatus, according to the fourth embodiment of the present invention.

Next, a polishing apparatus, according to the fourth embodiment of the present invention, will be described with reference to FIG. 9, FIG. 8(*a*), and FIG. 8(*b*). FIG. 9 illustrates the configuration of the polishing apparatus of the fourth embodiment. The same reference numerals as those in FIG. 3 and FIG. 8 are attached to the elements in FIG. 9. FIG. 9 also has the same configuration as those in FIG. 3 and FIG. 8.

Figure 10:
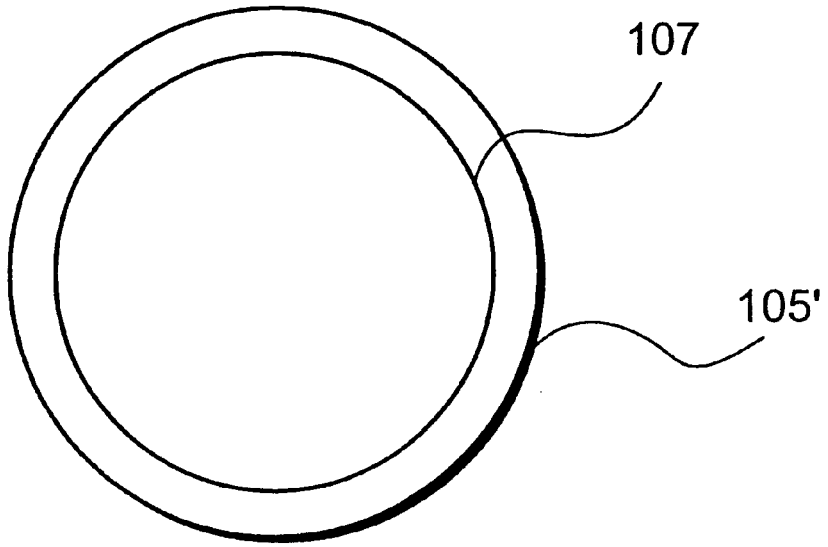
FIG. 10(*a*) and FIG. 10(*b*) are enlargements of a dresser, an adjusting ring, and other adjacent elements, in the polishing apparatus, according to the fourth embodiment of the present invention.
Figure 10:
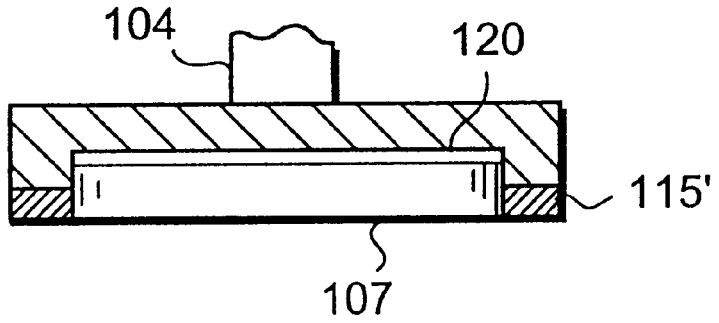

The polishing apparatus of the fourth embodiment includes a pressure applying mechanism 116. Wherein, the pressure applying mechanism 116 is comprised of a dresser 107 and an adjusting ring 115, which is made of a material, which includes the same principle component as that of the surface layer of the wafer product. It is noted that the dresser 107 and the adjusting ring 115' are separately and independently given a pressure. FIG. 10(*a*) and FIG. 10(*b*) illustrate enlargements of the dresser 107 and the adjusting ring 115'. FIG. 10(*a*) illustrate s a base of the dresser 107 and the adjusting ring 115', whereas FIG. 10(*b*) illustrates a cross section of them. A predetermined pressure, transmitted via a spindle 104, is put on the adjusting ring 115'; whereas a predetermined pressure is put on the dresser 107 by way of pressurized air 120 contained between the spindle 104 and the dresser 107.

(Fifth embodiment)

Figure 11:
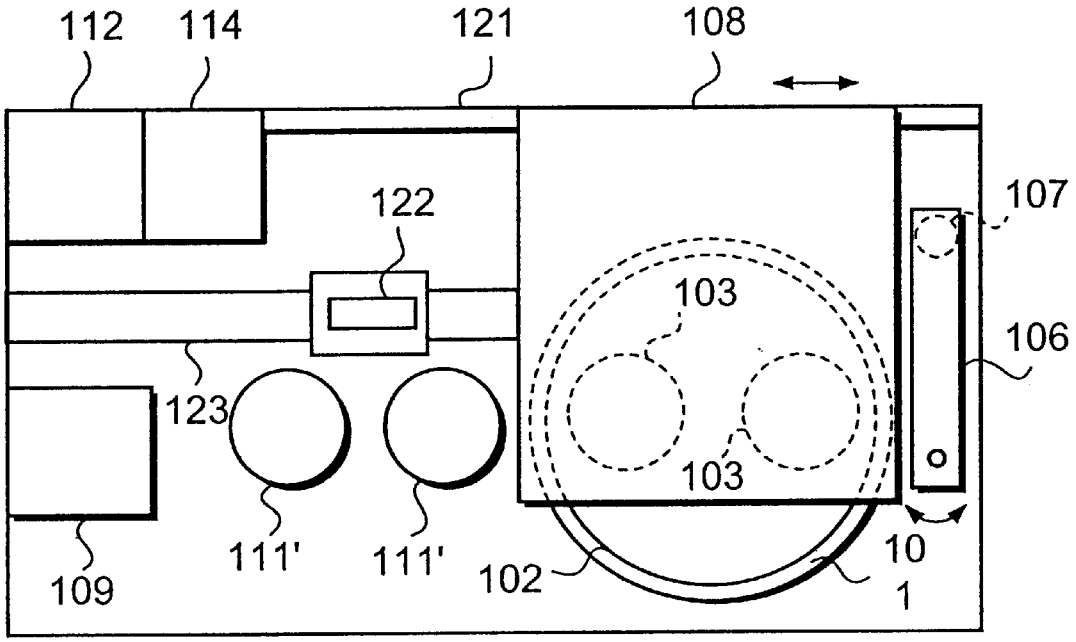
FIG. 11 illustrates the configuration of a polishing apparatus, according to the fifth embodiment of the present invention.

Next, a polishing apparatus, according to the fifth embodiment of the present invention, will be described with reference to FIG. 11. FIG. 11 illustrates the configuration of the polishing apparatus of the fifth embodiment. The same reference numerals as those in FIG. 3 and FIG. 10 are attached to the elements in FIG. 11, which have the same configuration as those in FIG. 3 and FIG. 10.

The polishing apparatus of the fifth embodiment is comprised of two carriers 103 for a single platen 1, thereby polishing two wafers at the same time. For adjustment of the surface of a polishing pad 102, two adjusting wafers such as adjusting quartz wafers, taken out of an adjusting wafer/storage unit 114, are supplied to the respective carriers 103.

The polishing pad 102 is polished next, by using the two adjusting wafers, which are stored in the respective carriers 103. Thereafter, the two adjusting wafers, stored in the respective carriers 103, are returned to the adjusting wafer/storage unit 114. More specifically, two quartz wafers are picked up from the adjusting wafer/storage unit 114, and moved into a left loading cup 111' and a right loading cup 111'. A polishing arm 108 is moved along a guide rail 121, so the two carriers 103, which are both fixed on the polishing arm 108, are moved to the places corresponding to the left loading cup 111' and the right loading cup 111'. The two quartz wafers are then vacuumed and held by the respective carriers 103. Thereafter, the polishing arm 109 is moved along the guide rail 121, so the two carriers 103 are returned to a position over the platen 101. A polishing process is then performed for the adjustment. A dressing processing is also performed at the same time or after polishing the polishing pad 102 is completed. Thereafter, the two quartz wafers are returned into the adjusting wafer/storage unit 114, via unloading cups (not shown in the Figure). It is preferable that the adjusting wafer/storage unit 114 functions to prevent the adjusting wafers from drying, by using pure water. The adjusting wafers are transmitted by a transmitting arm 122, along a guide rail 123.

According to the conventional, two-carriers-type polishing apparatus, in the case where a one residual wafer product is left unpolished, during the polishing operation for wafer products, an additional wafer product is supplied, so as to fill an empty carrier 103. This operation is needed, because the degradation of the quality of the polishing pad 102, resulting from polishing it by using two heads, is different from that resulting from polishing the same by using a single head; and thereby causing the quality of wafer products to become unstable. Conversely, according to the fifth embodiment, when a one residual wafer product is left unpolished, an adjusting wafer is picked up from the wafer storage unit, filling an empty carrier 103. In addition, unlike the conventional polishing apparatus, it is unnecessary to manually supply wafers to the polishing apparatus; thereby it is easy to automate the polishing process steps.

As described above, a polishing apparatus, according to the present invention, includes an adjusting material (an adjusting wafer), which is used to adjust the surface of a polishing pad. Wherein, the adjusting wafer is mainly made of the same ingredient as that which makes up the surface layer of a wafer product, which is to be polished. The adjusting wafer is given a pressure. And the polishing pad is also given the same pressure via the adjusting wafer, thereby polishing the polishing pad so as to adjust it by the adjusting wafer. Due to this, the number of adjusting materials is drastically reduced; and the rate of operation in polishing wafer products, is greatly improved by keeping high quality wafer products. In addition, an automated polishing apparatus can be easily fabricated by utilizing the above configuration, according to the present invention. This causes a decrease in the cost of polishing.

While the present invention has been described, in connection with certain preferred embodiments, it is to be understood that the subject matter encompassed by the present invention is not limited to those specific embodiments. On the contrary, it is intended to include all alternatives, modifications, and equivalents as can be included within the spirit and scope of the following claims.

What is claimed is:

1. A polishing apparatus, comprising:

a polishing pad for polishing an object;

an adjusting tool for adjusting a surface of said polishing pad, said adjusting tool composed entirely of a main ingredient of a surface layer of said object;

a first unit for holding said object and pressing said object against said polishing pad;

a second unit for holding said adjusting tool and pressing said adjusting tool against said polishing pad when said object is not pressed against said polishing pad; and a third unit for holding a dresser and pressing said dresser against said polishing pad whereby said dresser scrapes said surface of said polishing pad.

2. The polishing apparatus as claimed in claim 1, wherein said first unit and said second unit are a single unit.

3. The polishing apparatus as claimed in claim 2, wherein said adjusting tool is a ring for surrounding a periphery of said object.

4. The polishing apparatus as claimed in claim 3, wherein an underside of said holding ring does not contact with said polishing pad when said holding ring holds said object.

5. The polishing apparatus as claimed in claim 3, wherein said first unit further comprises a shim for adjusting a distance between said holding ring and said polishing pad.

6. The polishing apparatus as claimed in claim 3, wherein said first unit further comprises a means for individually applying pressure to said holding ring and said object.

7. The polishing apparatus, claimed in claim 2, further comprising a storage unit for storing said adjusting tool.

8. The polishing apparatus as claimed in claim 2, wherein said first unit is arranged to hold a plurality of said objects or a plurality of said adjusting tools and press said plurality of said objects or said plurality of said adjusting tools against said polishing pad at the same time.

9. The polishing apparatus as claimed in claim 1, wherein said third unit and said second unit are a single unit.

10. The polishing apparatus as claimed in claim 9, wherein said adjusting tool has a ring shape and provided around said dresser.

11. The polishing apparatus as claimed in claim 10, wherein said third unit comprises a means for individually applying pressure to said adjusting tool and said dresser.

12. The polishing apparatus as claimed in claim 1, wherein said surface layer of said object is silicon oxide and said adjusting tool is bulk quartz.

13. The polishing apparatus as claimed in claim 1, wherein said surface layer of said object is metal and said adjusting tool is the same bulk metal as said metal.

14. The polishing apparatus as claimed in claim 1, wherein said surface layer of said object is alloy metal and said adjusting tool is metal which is included in said alloy, and the content by percentage of said metal being more than 50%.

15. An adjusting method of a surface of a polishing pad in a method of polishing an object by pressing against said polishing pad, comprising the steps of pressing an adjusting tool composed entirely of a main ingredient of a surface layer of said object against said polishing pad when said object is not pressed against said polishing pad, and pressing a dresser against said polishing pad so that said dresser scrapes said surface of said polishing pad.

16. The adjusting method as claimed in claim 15, wherein said surface layer of said object is silicon oxide and said adjusting tool is bulk quartz.

17. The adjusting method as claimed in claim 15, wherein said surface layer of said object is metal and said adjusting tool is the same bulk metal as said metal.

18. The adjusting method as claimed in claim 15, wherein said surface layer of said object is alloy metal and said adjusting tool is metal which is included in said alloy, and the content by percentage of said metal being more than 50%.

* * * * *